United States Patent [19]

Nutt et al.

[11] 4,262,164

[45] Apr. 14, 1981

[54] TELECOMMUNICATIONS MULTIPAIR CABLE

[75] Inventors: Wendell G. Nutt, Dunwoody; Joseph P. Savage, Jr., Tucker, both of Ga.

[73] Assignee: Bell Telephone Laboratories, Incorporated, Murray Hill, N.J.

[21] Appl. No.: 97,810

[22] Filed: Nov. 27, 1979

[51] Int. Cl.[3] ..... H01B 11/04; H01B 11/06; H01B 7/02

[52] U.S. Cl. ..... 174/34; 174/36; 174/110 F

[58] Field of Search ..... 174/23 R, 23 C, 27, 174/32, 34, 36, 110 PM, 110 F, 113 R, 113 AS

[56] References Cited

U.S. PATENT DOCUMENTS

| | | | |
|---|---|---|---|
| 4,058,669 | 11/1977 | Nutt et al. | 174/34 |
| 4,174,236 | 11/1979 | Dougherty et al. | 174/110 F X |

OTHER PUBLICATIONS

Metcalf, E. D., "Cellular Insulation as an Answer to Material Conservation", *Proceedings of the 13th International Wire and Cable Symposium*, Atlantic City, N.J., pp. 53–58, Dec. 3–5, 1974.

Mitchell, D. M., "Dual Insulation Conserves Cable Materials", *Bell Laboratories Record*, vol. 54, No. 8, pp. 225–228, Sep. 1976, Published by Bell Laboratories, Murray Hill, NJ.

Durham et al., "LOCAP: A Low-Capacitance Cable for a Hih-Capacity System", *Bell Laboratories Record*, vol. 52, No. 7, pp. 217–221, Jul.–Aug. 1974, Published by Bell Laboratories, Murray Hill, NJ.

Hoth, D. F., "The T1 Carrier System", *Bell Laboratories Record*, vol. 40, No. 10, pp. 358–363, Nov. 1962, Published by Bell Laboratories, Murray Hill, NJ.

Nutt, W. G., et al., "Multipair Cables for Digital Transmission", *National Telecommunications Conference Proceedings*, pp. 21.1.1–21.1.5, Dec. 1978.

*Primary Examiner*—Laramie E. Askin

*Attorney, Agent, or Firm*—Sylvia J. Chin

[57] ABSTRACT

A multipair telephone cable (50) has been specifically developed for voice frequency and T1 carrier frequency transmission between cities. The copper wire gauge, dielectric diameter, and insulation expansion are uniquely designed so that this single cable design can be used for either air core or waterproof versions of the cable. Advantageously, both cable versions are compatible with existing carrier and voice frequency electronics. Also, the load coil spacing for voice frequency transmission and the regenerative repeater spacing for carrier transmission coincide in both versions.

2 Claims, 4 Drawing Figures

TELECOMMUNICATIONS MULTIPAIR CABLE

FIELD OF THE INVENTION

This invention relates to telephonic transmission systems, and more particularly to telephone cables installed between cities.

BACKGROUND OF THE INVENTION

The communication links between two central offices are known as trunks. When the central offices are in different cities, they are called intercity trunks; when one central office is in a large city and the other central office is in a relatively small remote community, they are called outstate trunks. Multipair cables are often the transmission medium used for intercity and outstate trunks to connect central offices located in different cities. Intercity and outstate cables are typically buried but may also be installed aerially or in ducts.

Today most intercity and outstate trunks utilize carrier systems although some still transmit at voice frequency. The T1 carrier system, which is described in the *Bell Laboratories Record,* Vol. 40, No. 10, November 1962, pp. 358–363, is the dominant carrier system used to connect cities 10 to 50 miles apart. Voice frequency transmission is still important on these cables because some pairs are needed for: (1) voice frequency trunks (2) fault locate and order wire circuits for T1 carrier and (3) subscriber services in certain situations.

The T1 carrier system was designed to utilize a 22-gauge wood pulp insulated conductor exchange cable. This cable, which was originally developed for voice frequency transmission, has conductor pairs with a mutual capacitance of 83 nanofarads/mile (nF/mile). Each T1 system provides 24 channels on two pairs by displacing two voice channels. The repeater or regenerator equipment for carrier or high frequency transmission for the pulp cable was designed to use a repeater spacing which coincided with a standard load coil spacing of 6000 feet for voice frequency transmission. This allowed for easy transition from voice to carrier transmission. The repeater equipment was, and still is, designed to accommodate at 5.1 dB/kft loss, the loss of the 22-gauge pulp cable at T1 carrier transmission.

For several years after the introduction of the T1 carrier system, trunk expansion was accomplished by converting from voice to carrier transmission on up to about half the pairs in pulp cable. But system needs increased so that, beginning about 1972, cables frequently came to be needed in which all pairs could be used for carrier while still having voice transmitting capability.

Meanwhile, voice frequency cables had evolved to new designs which utilized new materials and manufacturing processes. For instance, pulp cable, which is susceptible to lightning damage in aerial installations, had been largely replaced for such applications by air core plastic insulated conductor (PIC) cable. As another example, pulp cable's susceptibility to failure by water entry in buried installations caused it to be supplanted by waterproof cable. Waterproof cable was originally made with solid plastic insulated conductors and the spaces between pairs filled with petroleum jelly. Now, waterproof cable is also made with dual expanded plastic insulated conductor (DEPIC) cable filled with petroleum jelly.

These replacement cables are all designed primarily for voice frequency transmission and accordingly, retain the 83 nF/mile standard mutual capacitance. Each replacement cable is also available in 19-, 22-, 24-, or 26-gauge conductor sizes, the same gauges as are standard for pulp cable. So long as the conductor material and gauge are duplicated and the mutual capacitance is 83 nF/mile, the voice frequency transmission of the pulp cable is duplicated. Hence the load coil spacings for the replacement cables are still normally 6000 feet and utilize the standard voice frequency electronics.

But to achieve the same voice frequency characteristics, the dielectric layers of the conductors in the replacement cables differ in dimension so that the three replacement cables have different transmission performances, i.e. different transmission loss at the T1 carrier frequency. For instance, for the 22-gauge air core PIC cable, the resultant T1 carrier repeater spacing is approximately 7.0 kft; for the filled (waterproof) PIC cable, it is 8.0 kft; and, for the filled DEPIC cable, it is 7.3 kft. From this it can be seen that the coincident load coil and repeater spacings conceived for the original 22-gauge pulp cable has been lost. The result often has been that the telephone companies space T1 carrier repeaters, even on these improved cables, at 6000 feet to be coincident with the load coils.

Disclosed in U.S. Pat. No. 4,058,669, issued to Nutt et al and assigned to the assignee of the present application, is an optimized T1 carrier and voice frequency cable. This cable has a coincident repeater and load coil spacing of 6000 ft (6300 ft maximum) and utilizes the newly available materials and processes. This cable is intended for metropolitan area trunks ranging in length from 2 to 20 miles with the cable usually installed in ducts and frequently on routes in which T1 repeater manholes are already built at spacings of 6000 ft. The design of this cable called for new voice frequency electronics, as well as new T1 carrier electronics. The new T1 carrier electronics has the same gain as the T1 repeater equipment designed for the 22-gauge pulp cable at the T1 design frequency.

More background information is given in applicants' article, "Multipair Cables for Digital Transmission," *National Telecommunications Conference Proceedings,* Dec. 3–6, 1978. This article, to the extent relevant to this application, is hereby incorporated by reference.

One object of the present invention is to design for transmission between cities a more efficient family of air core and waterproof cables with conductors having improved performance characteristics for both voice frequency and carrier frequency transmission. Another object is that such cables are compatible with the existing voice frequency electronics for 83 nF/mile cables and the existing carrier frequency electronics used for the cable disclosed in U.S. Pat. No. 4,058,669. Still another object is that such cables are cost efficient from both the carrier and voice frequency standpoints. Also, a still further object is that such cables use less copper as well as expanded insulation which is economical and efficient.

SUMMARY OF THE INVENTION

A cable design which uses insulated conductors of a specific nominal wire size and expanded insulation of a specific range of thicknesses and expansion, has been developed which forms the basic building unit of either a waterproof or an air core cable. Both the air core and waterproof cable versions using this design are not only compatible with existing voice frequency and T1 carrier electronics, the repeater spacing for T1 carrier transmission and the load coil spacing for voice frequency coincides for both cable versions though the coincident spacing is different for the two versions. Making the voice and T1 carrier spacings coincident advantageously allows for smooth conversion from voice to carrier service on any cable pair.

To achieve all the above, the inventive cable comprises insulated conductors having the following characteristics. In one embodiment, the insulated conductors are each designed with a nominal 24-gauge copper wire having an insulative dielectric layer which is expanded in the range from 30 percent to 50 percent and has an outside diameter from 46 to 52 mils.

In a second embodiment, the insulated conductors are each designed also with a nominal 24-gauge copper wire but has an insulative dielectric layer comprising an expanded inner coat and a solid outer coat of polyolefin (DEPIC). In this second embodiment, the insulated conductors each have a diameter over dielectric (DOD) from approximately 46 to 52 mils, and an expansion of the expanded inner coat from approximately 35 to 55 percent. The second embodiment is desirable because the DEPIC insulation has very desirable manufacturing and field performance characteristics.

Performance efficiencies are achieved. Now the same sites can be used for housing both load coils and T1 carrier repeaters as done with 22-gauge wood pulp cable. Also, the cables are compatible with existing electronics. Even better though, the cables can be either waterproof or air core. Hence, a single manufacturing setup for insulating conductors, twisting pairs, and assembling the cable core can be efficiently used to manufacture both waterproof and air core cables.

Finally, the cables developed in accordance with this invention are cost efficient. They use 38 percent less copper than the state of the art cables. They are cost efficient in diameter, i.e., designed for more pairs per cable for any given cross section. This reduces installation costs, increases reel lengths, and decreases transportation costs affected by the size of the cable. Also, less electronics is needed over a span for both voice and carrier transmission since the repeater and load coil spacings are improved overall. In one embodiment, the cable has an 8 kft spacing for the waterproof cable version and 8.7 kft spacing for the air core cable version.

The invention, its objectives, features, and advantages will be readily apparent from a reading of the description to follow of illustrative embodiments.

DETAILED DESCRIPTION

Figure 1:
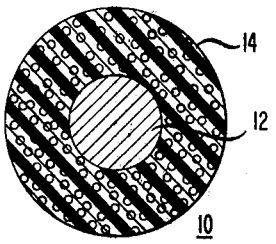
FIG. 1 is a transverse cross-sectional view of an insulated conductor having an expanded insulative dielectric layer.
Figure 2:
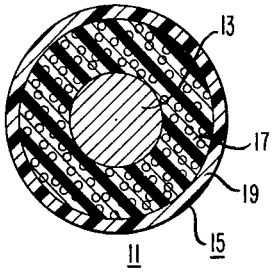
FIG. 2 is a transverse cross-sectional view of an alternate insulated conductor having an insulative dielectric layer comprising an expanded inner coat and a solid outer coat or skin.

FIGS. 1 and 2 depict in cross section the structural configuration of insulated conductors 10 and 11 respectively, which can be used in applicants' inventive cable design. In FIG. 1, insulated conductor 10 comprises a copper wire 12 and a single insulative dielectric layer 14 of polyolefin expanded with an inert gas. In FIG. 2, insulated conductor 11 comprises a copper wire 13 having an insulative dielectric layer 15. The dielectric layer 15 includes an inner coat 17 of polyolefin expanded with an inert gas, and an outer coat or skin 19 of solid polyolefin. A solid skin 19 is advantageous because it makes possible improved control of the inner coat 17 during manufacture. The solid skin 19 is also useful as a good mechanical layer for resisting crushing of the inner coat 17 and it can easily be color coded.

Figure 3:
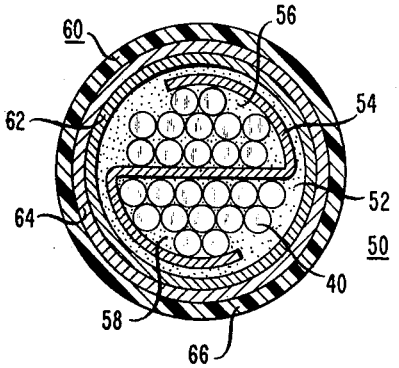
FIG. 3 illustrates a transverse schematic diagram of a multipair cable made with the conductors in FIG. 1 or 2.

FIG. 3 depicts how a typical telecommunication multipair cable 50 can be constructed by grouping a plurality of the conductors 10 or 11. First, the insulated conductors 10 or 11 are twisted into pairs. Next, the twisted pairs of insulated conductors 10 or 11 arranged in units 40 of 12 pairs, 13 pairs, 25 pairs, 50 pairs, 75 pairs, or 100 pairs according to some known twisting scheme, say for example, the twist frequency scheme disclosed in U.S. Pat. No. 4,058,669.

Then the cable units 40 are assembled in a cable core 52 which includes a transverse screen 54 separating the units 40 into two groups 56 and 58, so that two way transmission can occur in the cable 50. The interstices in the core 52 can be left empty if an air core version of the cable is desired or else filled with a waterproofing material such as petroleum jelly if a waterproof version of the cable is desired. In FIG. 3, the illustrative cable 50 has a cable sheath 60 comprising an aluminum inner jacket 62, a steel jacket 64, and an outer jacket 66 of polyethylene.

Figure 4:
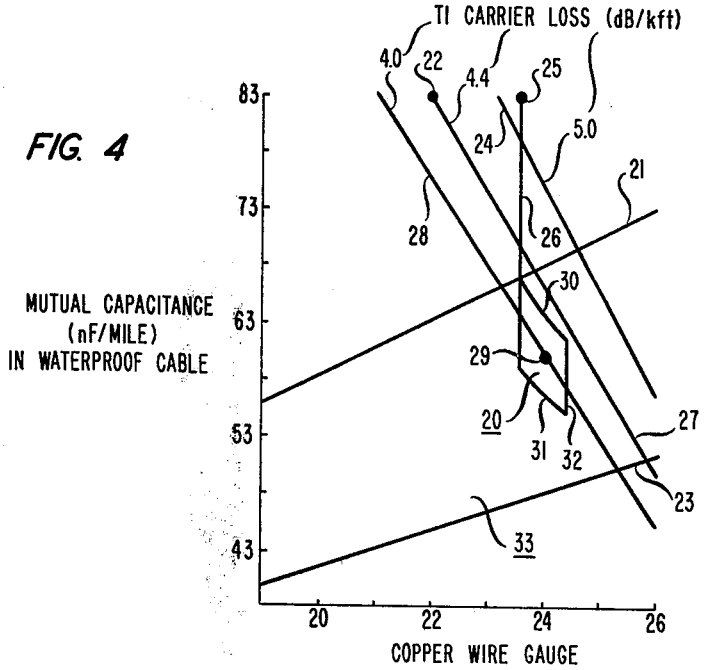
FIG. 4 is a graph illustrating the characteristics of the FIG. 2 conductors used for a waterproof multipair cable made in accordance with this invention.

The FIG. 4 graph shows with region 20 a most preferred range of insulated conductor characteristics which the conductors 10 and 11 can have to construct a waterproof telecommunications multipair cable, such as cable 50, to realize the invention's advantages. In this graph, the region 20 is bounded by an upper line 30, a vertical line 26, lower line 31, and vertical line 32. The two lines 30 and 31 represent diameters outside the dielectric layer (DOD) of the conductors, which are 46 mils and 52 mils respectively. The vertical lines 26 and 32 define substantially a range for copper wire diameters which are nominally 24-gauge and are approximately 21 and 19.5 mils respectively.

The information in the FIG. 4 graph is shown specifically for waterproof cables filled with petroleum jelly, and on the assumption that the FIG. 2 conductors 11 are used. The conductors 11 are assumed to have a dielectric layer 15 consisting of an inner coat 17 of 50 percent expanded plastic or polyolefin and a 2 mil outer skin 19. The graph has an abscissa for a range of copper wire gauges and an ordinate for the mutual capacitance of conductor pairs in waterproof cable.

While the optimization has been performed for the waterproof cable design used in buried installation, simply omitting the filling compound provides an air core cable also essentially optimized.

Also, while the graph is based on the FIG. 2 conductor 11, in the range of conductor characteristics being analyzed, a conductor 10 having a 45 percent expanded dielectric layer 14 is equivalent to the conductor 11 having the 50 percent expanded inner coat 17 and the 2 mil outer skin 19.

An explanation of the other information on the FIG. 4 graph will help in understanding the significance of the optimum region 20. On this graph, point 22 represents the 83 nF/mile 22-gauge conductor 11 used to construct the waterproof DEPIC cable that has a T1 carrier loss of 4.4 dB/kft and a 7.3 kft spacing between repeaters. Line 27 represents a locus of waterproof DEPIC cables all having T1 carrier loss of 4.4 dB/kft. Line 21 represents a locus of conductors 11 having the minimum diameter outside the dielectric layer (DOD) for any given T1 carrier loss. Line 23 represents a locus of cable designs, which when using the conductor characteristics shown, have a minimum cost for any given T1 carrier loss.

For instance, the combinations of copper wire gauge and mutual capacitance giving the 4.4 dB/kft loss of 22-gauge 83 nF/mile cable are:

| Gauge | Capacitance |
|---|---|
| 22 | 83 |
| 23 | 74 |
| 24 | 66 |
| 25 | 58 |
| 26 | 50 |

Of these, the 24-gauge 66 nF/mile conductor design is nearest the minimum diameter locus 21 and therefore has the smallest diameter outside the dielectric layer, which would permit a maximum number of pairs in a given size cable and would have the lowest field installation costs. The 26-gauge 50 nF/mile design is near the minimum cost locus 23 and therefore has the lowest manufacturing cost, primarily because it has the least copper which currently contributes significantly to cable cost. The region 33 falling between the minimum diameter locus and the minimum cable cost locus thus represents one optimization which is attractive in designing a waterproof cable, as well as an air core cable, for T1 carrier.

Another optimization relates particularly to this invention, i.e., having T1 carrier repeaters coincident with load coils in such a way that standard voice frequency electronic equipment can be used. The most widely used voice frequency equipment is that designed for 88 mH load coils spaced at 6000-foot (H) increments on the 83 nF/mile cable. This is commonly referred to as, say, 24H88 for 24-gauge loaded cable.

The cable and voice frequency equipment will be compatible, if the impedance and bandwidth are adequately matched. This will essentially be accomplished if the inductance and capacitance of a section of the T1 carrier cable can be made to match those of a section of a standard cable. The inductance of a loaded cable section is the inductance of the load coil and the mutual inductance for a pair of conductors.

Since the inductance of a pair of conductors in a cable is a little less than one mH/mile, the inductance of a loaded cable section is nearly independent of length and is about 89 mH. Thus, the problem simplifies to just keeping the capacitance per section length constant. As the capacitance per mile decreases, the spacing between load coils is increased proportionately. For example, if the mutual capacitance is reduced by a factor of 2, the length of a cable section should be doubled.

An equivalent insulated conductor 11 on the FIG. 4 graph must first be found. As mentioned earlier, the originally used 22-gauge 83 nF/mile pulp cable had a T1 carrier design loss of 5.1 dB/kft. Point 25, in close proximity to a 5.0 dB/kft T1 carrier loss line 24, designates the 83 nF/mile conductor 11 that can be used to build a waterproof cable which affords a 6 kft T1 repeater spacing. The point 25 represents a conductor 11 of approximately 23.6 gauge.

From the above, it is apparent that reducing the mutual capacitance can increase the spacing needed for the voice frequency equipment. However, it is also desired that the spacing can increase at the same rate for T1 carrier repeaters. Line 26 has been found to represent a locus of conductor designs that will have coincident repeaters and load coils. It advantageously is a substantially straight vertical line which falls approximately on the 23.6 wire gauge. On this line 26, T1 carrier loss has been found to decrease in proportion to the decrease in capacitance so that the T1 repeater spacing can increase at the same rate as the load coil spacing.

Line 28 represents a locus of conductor characteristics having 4.0 dB/kft T1 loss, the lowest loss of the prior art cables it is desired to replace, i.e. the waterproof 22-gauge PIC cable. The intersection of lines 26 and 28 is within the desired optimum region 33 for a conductor 11 but an even wire gauge is preferred. To obtain an even wire gauge and to move nearer to the center of the optimum diameter and cable cost region 33, locus 28 was followed to the nominal design point 29, i.e. 24-gauge 60 nF/conductor, which is substantially in the center of the optimum region 20.

An actual waterproof version of a multipair cable similar to cable 50 has been made pursuant to the conductor characteristics in the region 20 as given in FIG. 4. Also, an air core version utilizing the same insulated conductors has been made. Both the air core and waterproof cables use a plurality of twisted pairs of dual-expanded plastic-insulated conductors 11, where each conductor has a copper wire 13 with a nominal 24 gauge, an inner expanded coat 17 of polyolefin expanded from 35 to 55 percent, and an outer solid skin 19 of solid polyolefin of approximately 1.5 to 2.5 mils. The diameter over the dielectric layer 15 is nominally 49 mils.

The air core cable version has a nominal mutual capacitance of 52 nF/mile and a T1 loss of 3.6 dB/kft. The waterproof cable version has a mutual capacitance which is nominally at 60 nF/mile and has a T1 carrier loss just under 4 dB/kft. These values for both cables afford coincident load coil and repeater spacings. The air core version of the cable made has an 8.7 kft repeater and load coil spacing, while the waterproof version of the cable made has an 8 kft repeater and load coil spacing.

A telecommunication multipair cable in this invention can be constructed in other known ways than illustrated in FIG. 3. For some other arrangements, see U.S. Pat. No. 4,058,669.

The spirit of the invention is embraced in the scope of the claims to follow.

We claim:

1. A telecommunications multipair cable (50) comprising one or more units (40) each comprising a plurality of insulated conductors (10) arranged in twisted pairs, each conductor comprising a copper wire (12) having an insulative dielectric layer (14) of polyolefin expanded with an inert gas, characterized in that:

each copper wire has a diameter in a range from approximately 19.5 mils to 21 mils;

the dielectric layer has an outside diameter in a range from approximately 46 mils to 52 mils; and wherein the dielectric layer is expanded by an amount in a range from 30 percent to 50 percent.

2. A telecommunications multipair cable (50) comprising one or more units (40) each comprising a plurality of insulated conductors (11) arranged in twisted pairs, each conductor comprising a copper wire (13) having an insulative dielectric layer (15) comprising a first polyolefin coat (17) expanded with an inert gas, and thereover, a second coat (19) of solid polyolefin, with the first coat constituting the major fraction of the thickness of the dielectric layer, characterized in that:

each copper wire has a diameter in a range from approximately 19.5 to 21 mils;

the dielectric layer has an outside diameter in a range from approximately 46 to 52 mils;

wherein the first coat is expanded by an amount in a range from 35 percent to 55 percent; and wherein the second coat has a thickness of 1.0 to 2.5 mils.

* * * * *